US007988747B2

(12) United States Patent
Lacheen et al.

(10) Patent No.: US 7,988,747 B2
(45) **Date of Patent: *Aug. 2, 2011**

(54) PRODUCTION OF LOW SULPHUR ALKYLATE GASOLINE FUEL

(75) Inventors: Howard Lacheen, Richmond, CA (US); Hye-Kyung C. Timken, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 544 days.

This patent is subject to a terminal disclaimer.

(21) Appl. No.: 11/932,533

(22) Filed: Oct. 31, 2007

(65) Prior Publication Data

US 2009/0107032 A1 Apr. 30, 2009

(51) Int. Cl.
*C10L 1/24* (2006.01)

(52) U.S. Cl. ..... 44/304; 208/238; 502/237; 585/709; 585/721

(58) Field of Classification Search ..... 44/304; 208/238; 502/237; 585/709, 721
See application file for complete search history.

(56) References Cited

U.S. PATENT DOCUMENTS

| | | | | |
|---|---|---|---|---|
| 2,418,093 | A | 3/1947 | Perkins et al. | |
| 2,434,094 | A | 1/1948 | Axe | |
| 3,789,581 | A * | 2/1974 | Carr et al. | 95/92 |
| 3,864,411 | A * | 2/1975 | Mueller | 570/246 |
| 4,122,245 | A | 10/1978 | Nardi et al. | |
| 4,463,071 | A | 7/1984 | Gifford et al. | |
| 4,463,072 | A | 7/1984 | Gifford et al. | |
| 5,104,840 | A | 4/1992 | Chauvin et al. | |
| 5,731,101 | A | 3/1998 | Sherif et al. | |
| 5,750,455 | A | 5/1998 | Chauvin et al. | |
| 6,028,024 | A | 2/2000 | Hirschauer et al. | |
| 6,096,680 | A | 8/2000 | Park | |
| 6,235,959 | B1 | 5/2001 | Hirschauer et al. | |
| 6,797,853 | B2 | 9/2004 | Houzvicka et al. | |
| 2003/0060359 | A1 | 3/2003 | Olivier-Bourbigou et al. | |
| 2003/0213728 | A1 * | 11/2003 | Saitou et al. | 208/17 |
| 2004/0045874 | A1 | 3/2004 | Olivier-Bourbigou et al. | |
| 2004/0077914 | A1 | 4/2004 | Zavilla et al. | |
| 2004/0133056 | A1 | 7/2004 | Liu et al. | |
| 2006/0135839 | A1 * | 6/2006 | Elomari et al. | 585/721 |

OTHER PUBLICATIONS

Chauvin, Y., Hirschauer, A., and Olivier, H., Alkylation of isobutane with 2-butene using 1-butyl-3-methylimidazolium chloride-aluminium chloride molten salts as catalysts, Journal of Molecular Catalysis, 1994, pp. 155-165, vol. 92, Elsevier, Cambridge, MA.

Peterson, J.R., Alkylate is Key for Cleaner Burning Gasoline, Preprints of Papers, American Chemical Society, Division of Fuel Chemistry, National Meeting of the American Chemical Society, 1996, pp. 916-921, vol. 41, Issue: 3, Stratco, Inc., Leawood, KS.

Wasserscheid, P. and Welton, T., Ionic Liquids in Synthesis, 2003, ISBN 3527305173, Wiley-VCH, Weinheim, Germany.

PCT/US08/078919, International Preliminary Report on Patentability, 11 sheets.

* cited by examiner

*Primary Examiner* — Prem C Singh
(74) *Attorney, Agent, or Firm* — Susan M. Abernathy; Steven H. Roth

(57) ABSTRACT

A method for producing a low sulphur containing fuel from a hydrocarbon feed having from 10 to 80 ppm of sulphur is disclosed. The method comprises contacting a hydrocarbon stream comprising at least one olefin having from 2 to 6 carbon atoms and at least one paraffin having from 4 to 6 carbon atoms with an ionic liquid catalyst and a halide containing additive in an alkylation reaction zone under alkylating conditions to produce a fuel having sulphur content up to 10 ppm.

21 Claims, No Drawings

PRODUCTION OF LOW SULPHUR ALKYLATE GASOLINE FUEL

FIELD OF THE INVENTION

The present invention relates to a process to produce low level sulphur alkylate gasoline fuel via paraffin alleviation using an ionic liquid catalyst system.

BACKGROUND OF THE INVENTION

In general, conversion of light paraffins and light olefins to more valuable cuts is very lucrative to the refining industries. This has been accomplished by alkylation of paraffins with olefins, and by polymerization of olefins. One of the most widely used processes in this field is the alkylation of isobutane with $C_3$-$C_5$ olefins to make gasoline cuts with high octane number using sulphuric and hydrofluoric acids. This process has been used by refining industries since the 1940's. The process was driven by the increasing demand for high quality and clean burning high octane gasoline.

Commercial paraffin alkylation processes in modern refineries use either sulphuric acid or hydrofluoric acid as catalyst. Both of these processes require extremely large amounts of acid to fill the reactor initially. The sulphuric acid plant also requires a significant daily withdrawal of spent acid for off-site regeneration. Then the spent sulphuric acid is incinerated to recover $SO_2/SO_3$ and fresh acid is prepared. The necessity of having to handle a large volume of used acid is considered a disadvantage of the sulphuric acid based processes. On the other hand, an HF alkylation plant has on-site regeneration capability and daily make-up of HF is orders of magnitude less. However, the aerosol formation tendency of HF presents a potentially significant environmental risk and some regard a HF alkylation process to be a less safe process than a $H_2SO_4$ alkylation process. Modern HF processes often require additional safety measures such as water spray and catalyst additive for aerosol reduction to minimize the potential hazards.

Although these catalysts have been successfully used to economically produce the best quality alkylate, the need for safer and environmentally-more friendly catalyst systems has become an issue to the industries involved. The ionic liquid catalyst of the present invention fulfills that need.

The progressive trend towards lower sulphur automotive fuels has resulted in an increased demand for hydrogen in crude oil refining for desulphurization. Smaller refineries typically have a single source of hydrogen—the reformer. Although hydrogen made with conventional Platinum/Rhenium reforming catalysts can be increased by lowering operating pressure, there is an attendant increase in catalyst fouling, which shortens catalyst run length. There are practical and economic limits to how far pressure can be lowered on semi regenerative reformers before the costs and disruptions of frequent shutdowns for catalyst regeneration become prohibitive. Typically, refiners limit run lengths to no less than 6 months, which in effect limits operating pressure to above 250 psig.

Ionic liquids are liquids that are composed entirely of ions. The so-called "low temperature" Ionic liquids are generally organic salts with melting points under 100 degrees C., often even lower than room temperature. Ionic liquids may be suitable for example for use as a catalyst and as a solvent in alkylation and polymerization reactions as well as in dimerization, oligomerization acetylation, metatheses, and copolymerization reactions.

One class of ionic liquids is fused salt compositions, which are molten at low temperature and are useful as catalysts, solvents and electrolytes. Such compositions are mixtures of components which are liquid at temperatures below the individual melting points of the components.

Ionic liquids can be defined as liquids whose make-up is entirely comprised of ions as a combination of cations and anions. The most common ionic liquids are those prepared from organic-based cations and inorganic or organic anions. The most common organic cations are ammonium cations, but phosphonium and sulphonium cations are also frequently used. Ionic liquids of pyridinium and imidazolium are perhaps the most commonly used cations. Anions include, but not limited to, $BF_4$—, $PF_6$—, haloaluminates such as $Al_2Cl_7$— and $Al_2Br_7$—, $[(CF_3SO_2)_2N)]$—, alkyl sulphates ($RSO_3$—), carboxylates ($RCO_2$—) and many other. The most catalytically interesting ionic liquids for acid catalysis are those derived from ammonium halides and Lewis acids (such as $AlCl_3$, $TiCl_4$, $SnCl_4$, $FeCl_3$ . . . etc). Chloroaluminate ionic liquids are perhaps the most commonly used ionic liquid catalyst systems for acid-catalyzed reactions.

Examples of such low temperature ionic liquids or molten fused salts are the chloroaluminate salts. Alkyl imidazolium or pyridinium chlorides, for example, can be mixed with aluminum trichloride ($AlCl_3$) to form the fused chloroaluminate salts. The use of the fused salts of 1-alkylpyridinium chloride and aluminum trichloride as electrolytes is discussed in U.S. Pat. No. 4,122,245. Other patents which discuss the use of fused salts from aluminum trichloride and alkylimidazolium halides as electrolytes are U.S. Pat. Nos. 4,463,071 and 4,463,072.

U.S. Pat. No. 5,104,840 describes ionic liquids which comprise at least one alkylaluminum dihalide and at least one quaternary ammonium halide and/or at least one quaternary ammonium phosphonium halide; and their uses as solvents in catalytic reactions.

U.S. Pat. No. 6,096,680 describes liquid clathrate compositions useful as reusable aluminum catalysts in Friedel-Crafts reactions. In one embodiment, the liquid clathrate composition is formed from constituents comprising (i) at least one aluminum trihalide, (ii) at least one salt selected from alkali metal halide, alkaline earth metal halide, alkali metal pseudohalide, quaternary ammonium salt, quaternary phosphonium salt, or ternary sulfonium salt, or a mixture of any two or more of the foregoing, and (iii) at least one aromatic hydrocarbon compound.

Other examples of ionic liquids and their methods of preparation may also be found in U.S. Pat. Nos. 5,731,101; 6,797,853 and in U.S. Patent Application Publications 2004/0077914 and 2004/0133056.

In the last decade or so, the emergence of chloroaluminate ionic liquids sparked some interest in AlCl3-catalyzed alkylation in ionic liquids as a possible alternative. For example, the alkylation of isobutane with butenes and ethylene in ionic liquids has been described in U.S. Pat. Nos. 5,750,455; 6,028,024; and 6,235,959 and open literature (*Journal of Molecular Catalysis,* 92 (1994), 155-165*; "Ionic Liquids in Synthesis*", P. Wasserscheid and T. Welton (eds.), Wiley-VCH Verlag, 2003, pp 275).

Aluminum chloride-catalyzed alkylation and polymerization reactions in ionic liquids may prove to be commercially viable processes for the refining industry for making a wide range of products. These products range from alkylate gasoline produced from alkylation of isobutane and isopentane with light olefins, to diesel fuel and lubricating oil produced by alkylation and polymerization reactions.

The alkylation of iso-butane with butene is a well established process in the oil and gas industry. Typical sulphur levels in gasoline are 5-30 ppm depending on the operating conditions. Alkylate sulphur comes from FCC butene, the amount of sulphur varies by refinery, but are typically 20-100 ppm. In order to lower the alkylate sulphur level, mercaptan sulphur can be removed before alkylation by caustic wash, but this process does not remove disulphides. Sulphur can be removed from alkylate during a finishing step by using ionic liquid catalysts. The ionic liquid based on aluminium chloride and cuprous chloride can remove sulphur without degrading alkylate.

SUMMARY OF THE INVENTION

In an aspect, a method for producing a low sulphur containing fuel from a hydrocarbon feed having from 10 to 80 ppm of sulphur comprises contacting a hydrocarbon stream comprising at least one olefin having from 2 to 6 carbon atoms and at least one paraffin having from 4 to 6 carbon atoms with an ionic liquid catalyst and a halide additive in an alkylation reaction zone under alkylating conditions to produce a low sulphur containing fuel having less than 10 ppm of sulphur.

Other aspects, features and advantages will be apparent from the description of the embodiments thereof and from the claims.

DETAILED DESCRIPTION

The present invention relates to an alkylation process comprising contacting a hydrocarbon mixture comprising at least one olefin having from 2 to 6 carbon atoms and at least one isoparaffin having from 3 to 6 carbon atoms with a catalyst system under alkylation conditions, the catalyst comprising a mixture of at least one acidic ionic liquid and at least one alkyl halide additive.

One component of a hydrocarbon feed to the process of the present invention is at least one olefin having from 2 to 6 carbon atoms. This component may, for example, be any refinery hydrocarbon stream which contains olefins.

Another component of a hydrocarbon feed to the process of the present invention is at least one paraffin having from 3 to 6 carbon atoms. This component may, for example, be any refinery hydrocarbon stream which contains paraffins. The paraffin is usually an isoparaffin. The olefin to paraffin molar ratio can be from 1:3 to 1:10.

The processes according to the present invention are not limited to any specific hydrocarbon feed and are generally applicable to the alkylation of $C_3$-$C_4$ isoparaffins with $C_2$-$C_6$ olefins from any source and in any combination. The olefin is selected from the group consisting of ethylene, propylene, n-butene, iso-butene, n-pentene, iso-pentene, n-hexene and mixtures thereof. The paraffin is selected from the group consisting of iso-butane, iso-pentanes, iso-hexanes and mixtures thereof. In an embodiment, the halide is chloride. The chloride containing additive is selected from the group consisting of hydrogen chloride, methyl chloride, ethyl chloride, propyl chloride, butyl chloride, iso-butyl chloride, t-butyl chloride, pentyl chlorides and mixtures thereof. In one aspect, the olefin to chloride molar ratio is greater than 200:1. In a second aspect, the olefin to chloride molar ratio is from 200:1 to 10:1. In a third aspect, the olefin to chloride molar ratio is from 125:1 to 10:1. In a fourth aspect, the olefin to chloride molar ratio is from 80:1 to 40:1. In a fifth aspect, the olefin to chloride molar ratio is from 60:1.

The ionic liquid catalyst can be selected from the group consisting of hydrocarbyl substituted pyridinium chloride and hydrocarbyl substituted imidazolium chloride. In an embodiment, the ionic liquid catalyst is n-butylpyridinium chloroaluminate. This ionic liquid catalyst can be optionally regenerated.

The sulphur content in the hydrocarbon feed is from 10 to 80 ppm. The sulphur content in the alkylate fuel after the processing is less than 10 ppm. In an aspect, the amount of sulphur in the alkylate fuel is less than 1 ppm. In another aspect, the amount of sulphur in the alkylate fuel is less than 2 ppm. In a third aspect, the amount of sulphur in the alkylate fuel is less than 5 ppm.

The olefin stream typically has sulphur content from 50 to 70 ppm. The paraffin stream typically has sulphur content less than 2 ppm. The combined olefin and paraffin hydrocarbon stream has typical sulphur content from 5 to 40 ppm. This hydrocarbon stream can be processed further by the present method.

Typical alkylation conditions can include a catalyst volume in the reactor of from 5 vol % to 50 vol %, a temperature of from −10° C. to +100° C., a pressure of from 300 kPa to 2500 kPa, an isopentane to olefin molar ratio of from 2 to 8 and a residence time of 5 min to 1 hour. In an embodiment, the alkylating conditions having a temperature in the range from −20 to 50 deg C. and a pressure in the range of 30 to 200 psig.

The olefin having sulphur content up to 100 ppm can be optionally pretreated to reduce the sulphur content. The process of pretreatment can be done by at least two processes. In one process, the olefin can be dried by passing through a molecular sieve such as 4A. This may lead to a reduction of sulphur content by up to 30%. In a second process, the olefin can be washed with caustic. This may decrease the sulphur content in the olefin by up to 20%.

In accordance with the present invention, a mixture of hydrocarbons as described above is contacted with a catalyst under alkylation conditions. A catalyst system in accordance with the present invention comprises at least one acidic ionic liquid and at least one alkyl halide additive. The present process is being described and exemplified with reference certain specific ionic liquid catalysts, but such description is not intended to limit the scope of the invention. The processes described may be conducted using any acidic ionic liquid catalysts by those persons having ordinary skill based on the teachings, descriptions and examples included herein.

The specific examples used herein refer to alkylation processes using ionic liquid systems, which are amine-based cationic species mixed with aluminum chloride. In such systems, to obtain the appropriate acidity suitable for the alkylation chemistry, the ionic liquid catalyst is generally prepared to full acidity strength by mixing one molar part of the appropriate ammonium chloride with two molar parts of aluminum chloride. The catalyst exemplified for the alkylation process is a 1-alkyl-pyridinium chloroaluminate, such as 1-butyl-pyridinium heptachloroaluminate.

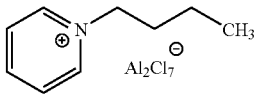

1-Butyl-pyridinium heptachloroaluminate

In general, a strongly acidic ionic liquid is necessary for paraffin alkylation, e.g. isoparaffin alkylation. In that case, aluminum chloride, which is a strong Lewis acid in a combination with a small concentration of a Broensted acid, is a preferred catalyst component in the ionic liquid catalyst scheme.

As noted above, the acidic ionic liquid may be any acidic ionic liquid. In one embodiment, the acidic ionic liquid is a chloroaluminate ionic liquid prepared by mixing aluminum trichloride ($AlCl_3$) and a hydrocarbyl substituted pyridinium halide, a hydrocarbyl substituted imidazolium halide, trialkylammonium hydrohalide or tetraalkylammonium halide of the general formulas A, B, C and D, respectively,

A

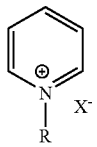

B

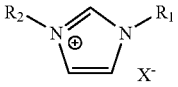

C

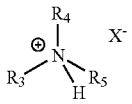

D

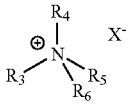

where R=H, methyl, ethyl, propyl, butyl, pentyl or hexyl group and X is a haloaluminate and preferably a chloride, and $R_1$ and $R_2$=H, methyl, ethyl, propyl, butyl, pentyl or hexyl group and where $R_1$ and $R_2$ may or may not be the same, and $R_3$, $R_4$, and $R_5$ and $R_6$=methyl, ethyl, propyl, butyl, pentyl or hexyl group and where $R_3$, $R_4$, $R_5$ and $R_6$ may or may not be the same.

The acidic ionic liquid is preferably selected from the group consisting of 1-butyl-4-methyl-pyridinium chloroaluminate, 1-butyl-pyridinium chloroaluminate, 1-butyl-3-methyl-imidazolium chloroaluminate and 1-H-pyridinium chloroaluminate.

In a process according to the invention an alkyl halide additive is acts as a promoter or co-catalyst. The alkyl halide is produced in accordance with the invention by reacting at least a portion of the olefinic feed with a hydrogen halide under hydrohalogenation conditions to convert at least a portion of the olefins to the alkyl halide. This is accomplished in accordance with the present invention by reacting at least a portion of the olefin feed stream with a hydrohalide under hydrohalogenation conditions and adding the resulting alkyl halide to the alkylation zone. In other words, the alkyl halide is generated from the olefin feed. For example, one can take a slip-stream of the olefin-containing refinery hydrocarbon feed and react that with HCl under conditions which would convert the olefins in the slip-stream into alkyl halides such as sec-butyl and t-butyl chloride. This alkyl halide containing stream can be injected into the catalyst stream being injected into the alkylation reactor.

Hydrohalogenation of olefins is well known. Examples of hydrochlorination of olefins can be found in U.S. Pat. Nos. 2,418,093 and 2,434,094, which are incorporated by reference herein.

The alkyl halide acts to promote the alkylation by reacting with aluminum chloride to form the prerequisite cation ions in similar fashion to the Friedel-Crafts reactions. The alkyl halides that may be used include alkyl bromides, alkyl chlorides and alkyl iodides. Preferred are isopentyl halides, isobutyl halides, butyl halides, propyl halides and ethyl halides. Alkyl chloride versions of these alkyl halides are preferable when chloroaluminate ionic liquids are used as the catalyst systems. Other alkyl chlorides or halides having from 1 to 8 carbon atoms may be also used. The alkyl halides may be used alone or in combination.

For chloroaluminate ionic liquids, the alkyl halide is preferably an alkyl chloride such as hydrogen chloride, methyl chloride, ethyl chloride, propyl chloride, butyl chloride, isobutyl chloride, t-butyl chloride, pentyl chlorides or mixtures thereof. The alkyl chlorides of choice are those derived from the isoparaffin and olefins used in a given alkylation reaction. For the alkylation of isobutane with butenes in chloroaluminate ionic liquids, for example, the preferable alkyl halides would be 1-butyl chloride, 2-butyl chloride or tertiary-butyl chloride or a combination of these chlorides. Most preferably, the alkyl chloride is a derivative of the olefin stream to invoke hydride transfer and the participation of the isoparaffin. The alkyl halides are used in catalytic amounts. Ideally, the amounts of the alkyl halides should be kept at low concentrations and not exceed the molar concentration of the catalyst $AlCl_3$. The amounts of the alkyl halides used may range from 0.05 mol %-100 mol % of the Lewis acid $AlCl_3$. Concentrations of the alkyl halides in the range of 0.05 mol %-10 mol % of the $AlCl_3$ are preferable in order to keep the acidity of the catalyst at the desired performing capacity. Also, the amount of the alkyl halide should be proportional to the olefin and not exceed the molar concentration of the olefin.

Without being bound to any theory, when ethyl chloride, for example is added to acidic chloroaluminate ionic liquids, ethyl chloride reacts with $AlCl_3$ to form tetrachloroaluminate ($AlCl_4^-$) and ethyl cation. Hydride shift from the isoparaffin (isopentane or isobutane) to the generated ethyl cation leads to the tertiary cation which propagates the inclusion of the isoparaffin in the reaction and, hence, the alkylation pathway.

A metal halide may be employed to modify the catalyst activity and selectivity. The metal halides most commonly used as inhibitors/modifiers in aluminum chloride-catalyzed olefin-isoparaffin alkylations include NaCl, LiCl, KCl, $BeCl_2$, $CaCl_2$, $BaCl_2$, $SrCl_2$, $MgCl_2$, $PbCl_2$, CuCl, $ZrCl_4$ and AgCl, as described by Roebuck and Evering (Ind. Eng. Chem. Prod. Res. Develop., Vol. 9, 77, 1970). Preferred metal halides are CuCl, AgCl, $PbCl_2$, LiCl, and $ZrCl_4$.

HCl or any Broensted acid may be employed as co-catalyst to enhance the activity of the catalyst by boasting the overall acidity of the ionic liquid-based catalyst. The use of such co-catalysts and ionic liquid catalysts that are useful in practicing the present invention is disclosed in U.S. Published Patent Application Nos. 2003/0060359 and 2004/0077914. Other co-catalysts that may be used to enhance the activity include IVB metal compounds preferably IVB metal halides such as $ZrCl_4$, $ZrBl_4$, $TiCl_4$, $TiCl_3$, $TiBr_4$, $TiBr_3$, $HfCl_4$, $HfBr_4$ as described by Hirschauer et al. in U.S. Pat. No. 6,028,024.

Due to the low solubility of hydrocarbons in ionic liquids, olefins-isoparaffins alkylation, like most reactions in ionic liquids is generally biphasic and takes place at the interface in the liquid state. The catalytic alkylation reaction is generally carried out in a liquid hydrocarbon phase, in a batch system, a semi-batch system or a continuous system using one reaction stage as is usual for aliphatic alkylation. The isoparaffin and olefin can be introduced separately or as a mixture. The molar ratio between the isoparaffin and the olefin is in the range 1 to 100, for example, advantageously in the range 2 to 50, preferably in the range 2 to 20. In a semi-batch system the isoparaffin is introduced first then the olefin, or a mixture of isoparaffin and olefin.

Catalyst volume in the reactor is in the range of 2 vol % to 70 vol %, preferably in the range of 5 vol % to 50 vol %. Vigorous stirring is desirable to ensure good contact between the reactants and the catalyst. The reaction temperature can be in the range −40° C. to +150° C., preferably in the range −20° C. to +100° C. The pressure can be in the range from atmospheric pressure to 8000 kPa, preferably sufficient to keep the reactants in the liquid phase. Residence time of reactants in the vessel is in the range a few seconds to hours, preferably 0.5 min to 60 min. The heat generated by the reaction can be eliminated using any of the means known to the skilled person. At the reactor outlet, the hydrocarbon phase is separated from the ionic phase by decanting, then the hydrocarbons are separated by distillation and the starting isoparaffin which has not been converted is recycled to the reactor.

In one embodiment high quality gasoline blending components of low volatility are recovered from the alkylation zone. Those blending components are then blended into gasoline. The hydrocarbon stream, after the processing by the present method, can be treated additionally to reduce the sulphur content to below 0.1 ppm.

The following Examples are illustrative of the present invention, but are not intended to limit the invention in any way beyond what is contained in the claims which follow.

Example 1

Preparation of n-butylpyridinium chloroaluminate Catalyst

N-butylpyridinium chloroaluminate ($C_5H_5NC_4H_9Al_2C_7$) ionic liquid catalyst was purchased. The catalyst had the following composition:

| | |
|---|---|
| Wt % Cl | 56.5 |
| Wt % C | 24.6 |
| Wt % H | 3.2 |
| Wt % N | 3.3 |

A paraffin feed containing predominantly isobutane and an olefin feed containing predominantly C3, C4, and C5 olefins were obtained from a refinery. The initial hydrocarbon stream has olefin sulphur content of 62 ppm and paraffin sulphur content less than 1 ppm.

The hydrocarbon feed properties are given below;

TABLE 1

Properties of Hydrocarbon Feeds for Alkylate Gasoline Synthesis

| wt % | Paraffin Feed | Olefin Feed |
|---|---|---|
| $C_1$ | 0.04 | 0.30 |
| $C_2$ | 0.05 | 0.05 |
| $C_3$ | 6.8 | 5.80 |
| $iC_4$ | 86.63 | 43.08 |
| $nC_4$ | 5.84 | 12.07 |
| $cyC_5$ | 0.00 | 0.00 |
| $iC_5$ | 0.44 | 0.80 |
| $nC_5$ | 0.01 | 0.03 |
| $C_{6+}$ | 0.01 | 0.02 |
| $C_{3-}$ | 0.06 | 4.71 |
| $C_{4-}$ | 0.12 | 32.67 |
| $C_{5-}$ | 0.00 | 0.21 |
| acetylene | 0.00 | 0.01 |
| butadiene | 0.00 | 0.25 |
| Sum | 100.00 | 100.00 |

Evaluation of $C_3$-$C_5$ olefin alkylation with isobutane was performed in a 100 cc continuously stirred tank reactor. 8:1 molar ratio of isobutane and olefin mixture was fed to the reactor while vigorously stirring at 1600 RPM. An ionic liquid catalyst was fed to the reactor via a second inlet port targeting to occupy 6-24 vol % in the reactor. A small amount of anhydrous HCl was added to the process. The average residence time (combined volume of feeds and catalyst) was about 8 minutes. The outlet pressure was maintained at 50-150 psig using a backpressure regulator. The reactor temperature was maintained at 0 deg C. using external cooling. The reactor effluent was separated in a 3-phase separator into C4-gas, alkylate hydrocarbon phase, and the ionic liquid catalyst. Detailed composition of alkylate gasoline was analyzed using gas chromatography. We observed 100% conversion of olefin, alkylate yield is nearly 200 wt % as predicted from the alkylation chemistry. The resulting alkylate gasoline has a sulphur content of 10 ppm. Results from Examples 1 to 6 are summarized in Table 2.

TABLE 2

Sulphur Content in Alkylate Gasoline by Process in accordance with Invention

| Example No. | Olefin/Cl Co-Catalyst Molar Ratio | Alkylate Sulphur, ppm |
|---|---|---|
| 1 | 161 | 10 |
| 2 | 125 | 4.8 |
| 3 | 81 | <1 |
| 4 | 60 | <1 |
| 5 | 40 | <1 |
| 6 | 26 | <1 |

Example 2

Alkylation of Isobutane with C3-C5 Olefins Using Ionic Liquid Catalyst and tert-butylchloride Co-Catalyst Another alkylation run was conducted by the procedure of Example 1, except tert-butyl chloride co-catalyst was used instead of HCl. The resulting alkylate gasoline had a sulphur content of 4.8 ppm. The initial hydrocarbon stream has olefin sulphur content of 62 ppm and paraffin sulphur content less than 1 ppm.

Example 3

Alkylation of Isobutane with C3-C5 Olefins Using Ionic Liquid Catalyst and HCl Co-Catalyst Another alkylation run was conducted by the procedure of Example 1, except with an olefin to Cl co-catalyst molar ratio of 81. The resulting alkylate gasoline had a sulphur content of <1 ppm. The initial hydrocarbon stream has olefin sulphur content of 62 ppm and paraffin sulphur content less than 1 ppm.

Example 4

Alkylation of Isobutane with C3-C5 Olefins Using Ionic Liquid Catalyst and tert-butylchloride Co-Catalyst Another alkylation run was conducted by the procedure of Example 1, except using tert-butylchloride with an olefin to Cl co-catalyst molar ratio of 60. The resulting alkylate gasoline had a sulphur content of <1 ppm. The initial hydrocarbon stream has olefin sulphur content of 62 ppm and paraffin sulphur content less than 1 ppm.

Example 5

Alkylation of Isobutane with C3-C5 Olefins Using Ionic Liquid Catalyst and HCl Co-Catalyst Another alkylation run was conducted by the procedure of Example 1, except with a olefin to Cl co-catalyst molar ratio of 40. The resulting alkylate gasoline had a sulphur content of <1 ppm. The initial hydrocarbon stream has olefin sulphur content of 62 ppm and paraffin sulphur content less than 1 ppm.

Example 6

Alkylation of Isobutane with C3-C5 Olefins Using Ionic Liquid Catalyst and tert-butylchloride Co-Catalyst Another alkylation run was conducted by the procedure of Example 1, except using tert-butylchloride with an olefin to Cl co-catalyst molar ratio of 26. The resulting alkylate gasoline had a sulphur content of <1 ppm. The initial hydrocarbon stream has olefin sulphur content of 62 ppm and paraffin sulphur content less than 1 ppm.

Comparative Example 1

Comparison of Alkylate Gasoline Sulphur with HF Alkylation Unit

A sample of alkylate gasoline was obtained from a refinery HF alkylation plant, and various properties were compared with the alkylate produced by the present method.

TABLE 3

Comparison of Sulphur Content in Alkylate Gasoline

| | HF Alkylate | Present Method |
|---|---|---|
| D86, Initial Boiling Point, deg F. | 97 | 106 |
| 10%, deg F. | 151 | 178 |
| 30%, deg F. | 199 | 211 |
| 50%, deg F. | 213 | 223 |
| 70%, deg F. | 225 | 233 |
| 90%, deg F. | 274 | 270 |
| Final Boiling Point | 397 | 399 |
| API Gravity | 72 | 69.8 |
| Research Octane Number, F1 | 91.9 | 91.4 |
| Motor Octane Number-F2 | 90.4 | 90.2 |
| Total Sulphur, ppm | 6 | <1 |

The results in Table 1 show that high quality alkylates gasoline can be produced by a process in accordance with the invention. The alkylate gasoline produced by the present method had sulphur content of <1 ppm, which is below the detection limit while the alkylate from the HF unit showed 6 ppm S.

Example 7

Alkylate Gasoline Sulphur with $H_2SO_4$ Alkylation Unit

Typical sulphur content of $H_2SO_4$ Alkylation Unit was published by Stratco, Inc on Dec. 31, 1996. The report indicate that the sulphur content of alkylate gasoline from commercial $H_2SO_4$ Alkylation units are in the range of 10-26 ppm sulphur.

TABLE 4

Comparison of Sulphur Content in Alkylate Gasoline

| | $H_2SO_4$ - Stratco Method | Present Method |
|---|---|---|
| Sulphur, ppm | 10-26 | 0.001-10 |

The sulphur content for the Stratco Method is described in the publication by I. Randall Peterson, in "Alkylate is Key for Clean Burning Gasoline" Preprints of Papers, American Chemical Society, Division of Fuel Chemistry, Nat. Meeting of the ACS, Orlando, Fla. (USA) 1996, published on Dec. 31, 1996.

What is claimed is:

1. A method for producing a low sulphur containing fuel, comprising: contacting a hydrocarbon feed stream comprising at least one olefin having from 2 to 6 carbon atoms and at least one paraffin having from 4 to 6 carbon atoms with a co-catalyst comprising an ionic liquid catalyst and an additive comprising a halide in an alkylation reaction zone under alkylating conditions using a single reaction stage;

wherein the hydrocarbon feed stream comprises from 10 to 80 ppm of sulphur;

wherein an olefin to halide molar ratio in the alkylation reaction zone is maintained from 60:1 to less than 125:1; and wherein the at least one olefin is converted to produce a fuel containing less than 4.8 ppm sulphur.

2. The method of claim 1, wherein the olefin is selected from the group consisting of ethylene, propylene, n-butene, iso-butene, n-pentene, iso-pentene, n-hexene and mixtures thereof.

3. The method of claim 1, wherein the paraffin is selected from the group consisting of iso-butane, iso-pentanes, iso-hexanes and mixtures thereof.

4. The method of claim 1, wherein the halide is a chloride.

5. The method of claim 4, wherein the additive comprising the halide is selected from the group consisting of hydrogen chloride, methyl chloride, ethyl chloride, propyl chloride, butyl chloride, iso-butyl chloride, t-butyl chloride, pentyl chlorides and mixtures thereof.

6. The method of claim 1, wherein the olefin to halide molar ratio is from 60:1 to 81:1.

7. The method of claim 1, wherein the ionic liquid catalyst is selected from the group consisting of hydrocarbyl substituted pyridinium chloride and hydrocarbyl substituted imidazolium chloride.

8. The method of claim 1, wherein the ionic liquid catalyst is n-butylpyridinium chloroaluminate.

9. The method of claim 1, wherein the alkylating conditions include a temperature from −20 to 50 deg C. and a pressure in the range of 30 to 200 psig.

10. The method of claim 1, wherein the amount of sulphur in the fuel is less than 1 ppm.

11. The method of claim 1, wherein the amount of sulphur in the fuel is less than 2 ppm.

12. The method of claim 1, wherein the hydrocarbon stream comprises from 20 to 40 ppm of sulphur.

13. The method of claim 1, wherein the at least one olefin has a high sulphur content up to 100 ppm and the at least one olefin is pretreated to reduce the high sulphur content to less than 10 ppm.

14. The method of claim 1, wherein the olefin to paraffin molar ratio is from 1:3 to 1:10.

15. The method of claim 1, wherein the halide containing additive is a hydrogen halide.

16. The method of claim 1, wherein the contacting under alkylating conditions is from a few seconds to about 8 minutes.

17. The method of claim 1, wherein the halide containing additive is an alkyl halide that is generated from the at least one olefin.

18. The method of claim 1, wherein the fuel has a Research Octane Number of at least 91.4.

19. A method for producing a low sulphur containing fuel, comprising: contacting a hydrocarbon feed stream comprising at least one olefin having from 2 to 6 carbon atoms and at least one paraffin having from 4 to 6 carbon atoms with a co-catalyst comprising an ionic liquid catalyst and an additive comprising a halide in an alkylation reaction zone under alkylating conditions;

wherein the hydrocarbon feed stream comprises from 10 to 80 ppm of sulphur;

wherein the co-catalyst has an olefin to halide molar ratio from 60:1 to less than 125:1; and wherein the at least one olefin is converted to produce a fuel containing less than 4.8 ppm sulphur; and wherein the fuel is recovered from the alkylation zone without any further treatment to reduce the sulphur content.

20. A method for producing a low sulphur containing fuel, comprising: contacting a hydrocarbon feed stream comprising at least one olefin having from 2 to 6 carbon atoms and at least one paraffin having from 4 to 6 carbon atoms with a co-catalyst comprising an ionic liquid catalyst and hydrogen chloride in an alkylation reaction zone under alkylating conditions using one reaction stage;

wherein the ionic liquid catalyst is a hydrocarbyl substituted pyridinium chloroaluminate or a hydrocarbyl substituted imidazolium chloroaluminate;

wherein the hydrocarbon feed stream comprises from 10 to 80 ppm of sulphur;

wherein the co-catalyst has an olefin to halide molar ratio of 60:1 to 161:1;

wherein the at least one olefin is converted to produce a fuel containing less than 10 ppm sulphur; and wherein the fuel is recovered from the alkylation zone without any further treatment to reduce the sulphur content.

21. The method of claim 1, wherein 100 wt % of the at least one olefin is converted.

* * * * *